US009529288B1

(12) United States Patent
Sugawara et al.

(10) Patent No.: US 9,529,288 B1
(45) Date of Patent: Dec. 27, 2016

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Atsushi Sugawara, Kanagawa (JP); Kana Yoshida, Kanagawa (JP); Tsuyoshi Murakami, Kanagawa (JP); Yukiaki Nakamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/007,911

(22) Filed: Jan. 27, 2016

(30) Foreign Application Priority Data

Aug. 25, 2015 (JP) ..... 2015-165797

(51) Int. Cl.

| | |
|---|---|
| ***G03G 9/093*** | (2006.01) |
| ***G03G 9/08*** | (2006.01) |
| ***G03G 15/08*** | (2006.01) |
| ***G03G 9/087*** | (2006.01) |

(52) U.S. Cl.
CPC ..... *G03G 9/08* (2013.01); *G03G 9/08755* (2013.01); *G03G 15/0865* (2013.01)

(58) Field of Classification Search
CPC ..... G03G 9/09307; G03G 9/09342
See application file for complete search history.

(56) References Cited

U.S. PATENT DOCUMENTS

2009/0047595 A1* 2/2009 McDougall ..... G03G 9/0804 430/137.14
2011/0059394 A1 3/2011 Mutoh et al.

FOREIGN PATENT DOCUMENTS

JP 2011-081344 A 4/2011
JP 2013-003196 A 1/2013
JP 2014-209188 A 11/2014

* cited by examiner

*Primary Examiner* — Hoa V Le
(74) *Attorney, Agent, or Firm* — Oliff PLC

(57) ABSTRACT

An electrostatic charge image developing toner includes a toner particle containing a binder resin, a release agent, and an inorganic mineral, wherein 80% or more of the entire release agent is present in a portion within 400 nm from the surface of the toner particle and 80% or more of the entire inorganic mineral is present in a portion within 400 nm from the surface of the toner particle.

9 Claims, 3 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2015-165797 filed Aug. 25, 2015.

BACKGROUND

1. Technical Field

The present invention relates to an electrostatic charge image developing toner, an electrostatic charge image developer, and a toner cartridge.

2. Related Art

A method of visualizing image information through electrophotography is currently used in various fields. In electrophotography, an electrostatic charge image is formed on a surface of an image holding member as image information through charging and electrostatic charge image formation. A toner image is formed on the surface of the image holding member using a developer containing a toner, and the toner image is transferred to a recording medium, and then the toner image is fixed onto a surface of the recording medium. The image information is visualized as an image through these processes.

SUMMARY

According to an aspect of the invention, there is provided an electrostatic charge image developing toner including:

a toner particle containing a binder resin, a release agent, and an inorganic mineral, wherein 80% or more of the entire release agent is present in a portion within 400 nm from a surface of the toner particle, and 80% or more of the entire inorganic mineral is present in a portion within 400 nm from the surface of the toner particle.

BRIEF DESCRIPTION OF THE DRAWINGS

Exemplary embodiments of the present invention will be described in detail based on the following figures, wherein.

DETAILED DESCRIPTION

Figure 1:
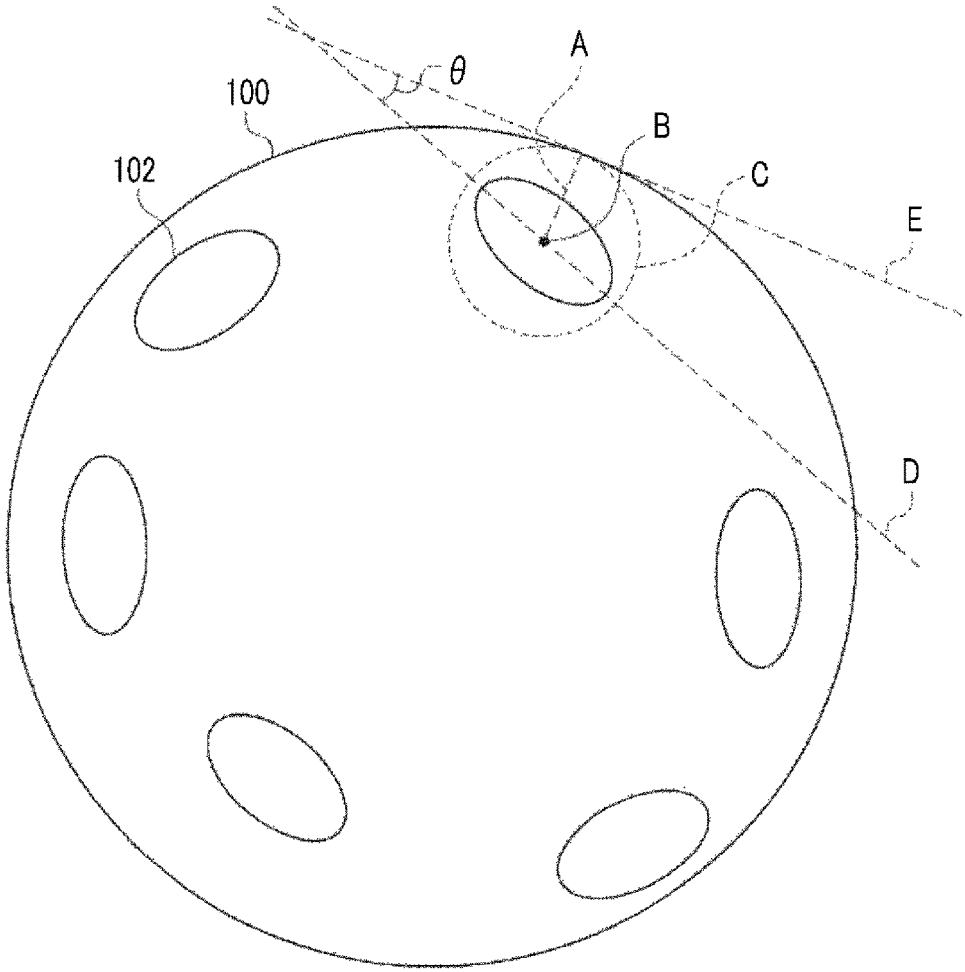
FIG. 1 is a diagram showing a cross section of a toner particle according to the exemplary embodiment.

Hereinafter, exemplary embodiments which are examples of the invention will be described in detail.

Electrostatic Charge Image Developing Toner

An electrostatic charge image developing toner according to the exemplary embodiment (hereinafter, also referred to as a "toner") contains a toner particle having a binder resin, a release agent, and an inorganic mineral.

In the toner particle, 80% or more of the entire release agent is present in a portion within 400 nm from the surface of the toner particle (hereinafter, a percentage of the release agent which is present in a portion within 400 nm from the surface of the toner particle is also referred to as a "presence ratio (400 nm) of the release agent").

In addition, 80% or more of the entire inorganic mineral is present in a portion within 400 nm from the surface of the toner particle (hereinafter, a percentage of the inorganic mineral present in a portion within 400 nm from the surface of the toner particle is also referred to as a "presence ratio (400 nm) of the inorganic mineral").

According to the configuration described above, the toner according to the exemplary embodiment prevents occurrence of image deletion. The reason therefor is not clear, but the following are assumed.

A toner in which a release agent is arranged in a surface portion of a toner particle (for example, a range within 400 nm from the surface of the toner particle) is excellent in maintaining peeling properties of a fixed image from a fixing member. However, since the release agent is arranged in the surface portion of the toner particle, abrasion occurs in the surface portion of the toner particle by stirring in a developing unit (developing device), and the release agent is easily exposed from the surface of the toner particle. Particularly, when an electrostatic charge image developer (hereinafter, also referred to as a "developer") is a two-component developer, abrasion more easily occurs in the surface portion of the toner particle due to friction with a carrier, and the release agent is more easily exposed on the surface of the toner particle. Accordingly, the solidification of the toner may occur in the developing device due to aggregation of the toner particles on which the release agents are exposed. If an image is formed in a state where the toner is solidified, image deletion may easily occur in an image to be formed. It is found that this phenomenon easily occurs when a solid image having high image density (for example, image density equal to or greater than 80%) is formed after continuously forming images having low image density (for example, image density equal to or smaller than 5%), and more easily occurs particularly when an image is formed in a high temperature and high humidity environment (for example, temperature of 32° C. and humidity of 90 RH %).

Toner is agitated in the developing device and friction occurs on the surface of the toner particle. In a case of forming an image having low image density, an amount of toner transferred to the image holding member is small, and the same toner particles are continuously agitated in the developing device, and therefore, friction with the surface of the toner particle more easily occurs. It is considered that while images having low image density are continuously formed, the release agent is exposed on the surface of the toner particle due to abrasion occurring in the surface portion of the toner particle, the toner particles on which the release agents are exposed are aggregated and solidification of the toner occurs. This phenomenon more easily occurs, when the developer is a two-component developer. As a result, when a solid image having high image density is formed after continuously forming images having low image density, image deletion easily occurs.

With respect to this, the toner according to the exemplary embodiment includes, as described above, a toner particle in which the presence ratio of the release agent is equal to or greater than 80% and the presence ratio (400 nm) of the inorganic mineral is equal to or greater than 80%.

When the presence ratio (400 nm) of the inorganic mineral is equal to or greater than 80%, strength of the surface of the toner particle is improved due to a filler effect of the inorganic mineral. Accordingly, for example, even when a mechanical load is applied to the toner particles due to friction with the surface of the toner particles in the developing device, abrasion to the surface portion of the toner particle is prevented, and accordingly, the release agent present in the surface portion of the toner particles is prevented from being exposed on the surface of the toner particle. As a result, since solidification of the toner occurring in the developing device due to aggregation of the tone particles on which the release agents are exposed is prevented, the occurrence of image deletion is prevented, even when an image having high image density is formed after continuously forming images having low image density in a high temperature and high humidity environment.

Based on the above, it is assumed that the toner according to the exemplary embodiment prevents occurrence of image deletion with the configurations described above.

Hereinafter, the toner according to the exemplary embodiment will be described in detail.

The toner according to the exemplary embodiment contains a toner particle, and if necessary, an external additive.

Toner Particles

The toner particle according to the exemplary embodiment includes a specific release agent domain, and for example, contains a binder resin, a release agent, if necessary, a colorant and other additives.

Binder Resin

Examples of the binder resins include a vinyl resin formed of a homopolymer of monomers such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a copolymer obtained by combining two or more kinds of these monomers.

Examples of the binder resin include a non-vinyl resin such as an epoxy resin, a polyester resin, a polyurethane resin, a polyamide resin, a cellulose resin, a polyether resin, and a modified rosin, a mixture of these and a vinyl resin, or a graft polymer obtained by polymerizing a vinyl monomer in the presence thereof.

These binder resins may be used alone or in combination with two or more kinds thereof.

A polyester resin is suitable as the binder resin.

As the polyester resin, a well-known polyester resin is used, for example.

As the polyester resin, a well-known polyester resin is used, for example.

Examples of the polyester resin include condensation polymers of polyvalent carboxylic acids and polyols. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

The glass transition temperature (Tg) of the polyester resin is preferably from 50° C. to 80° C., and more preferably from 50° C. to 65° C.

The glass transition temperature is obtained by a DSC curve which is obtained by a differential scanning calorimetry (DSC), and more specifically, is obtained by "Extrapolating Glass Transition Starting Temperature" disclosed in a method for obtaining the glass transition temperature of "Testing Methods for Transition Temperatures of Plastics" in JIS K-7121-1987.

A weight-average molecular weight (Mw) of the polyester resin is preferably from 5,000 to 1,000,000, and more preferably from 7,000 to 500,000.

The number-average molecular weight (Mn) of the polyester resin is preferably from 2,000 to 100,000.

The molecular weight distribution Mw/Mn of the polyester resin is preferably from 1.5 to 100, and more preferably from 2 to 60.

The weight-average molecular weight and the number-average molecular weight are measured by gel permeation chromatography (GPC). The molecular weight measurement by GPC is performed with a THF solvent using HLC-8120 GPC, which is GPC manufactured by Tosoh Corporation as a measurement device by using TSKGEL Super HM-M (15 cm), which is a column manufactured by Tosoh Corporation. The weight-average molecular weight and the number-average molecular weight are calculated using a calibration curve of molecular weight created with a monodisperse polystyrene standard sample from results of this measurement.

The polyester resin is obtained with a well-known preparing method. Specific examples thereof include a method of conducting a reaction at a polymerization temperature set to 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is preferably from 40% by weight to 95% by weight, more preferably from 50% by weight to 90% by weight, and even more preferably from 60% by weight to 85% by weight, with respect to the entire toner particles.

Release Agent

Examples of the release agent include hydrocarbon waxes; natural waxes such as carnauba wax, rice wax, and candelilla wax; synthetic or mineral/petroleum waxes such as montan wax and Fischer Tropsch Wax; and ester waxes such as fatty acid esters and montanic acid esters. The release agent is not limited thereto.

Among these, hydrocarbon waxes are preferable, because a shape of the release domain easily satisfy Condition (1) to Condition (4) described above.

The melting temperature of the release agent is preferably from 50° C. to 110° C., and more preferably from 60° C. to 100° C.

Further, the melting temperature is determined from a DSC curve obtained by differential scanning calorimetry (DSC), using the "melting peak temperature" described in the method of determining a melting temperature in the "Testing Methods for Transition Temperatures of Plastics" in JIS K-7121-1987.

The content of the release agent is, for example, preferably from 1% by weight to 20% by weight, and more preferably from 5% by weight to 15% by weight, with respect to the entire toner particles.

Inorganic Mineral

The inorganic mineral is not particularly limited, but in order to prevent occurrence of image deletion, a silicate mineral may be used, and a clay mineral having a layered structure (hereinafter, also referred to as a "layered clay mineral") is preferably used. When the inorganic mineral is a layered clay mineral, 80% or more of the entire inorganic mineral is easily present in a portion within 400 nm from the surface of the toner particle and strength of the toner particle is easily improved due to a filler effect.

As the layered clay mineral, a type having great cation exchange capacity may be selected, in order to prevent occurrence of image deletion. Since the layered clay mineral having great cation exchange capacity is easily bonded with a carboxylic group present in the surface of the binder resin in the toner particle and anions such as sulfonic acid ions of a surfactant adsorbed to the binder resin, for example, the strength of the surface of the toner particle is easily improved.

Specific examples of the layered clay mineral include kaolinite (kaolinite, halloysite, or the like), smectite (montmorillonite, beidellite, saponite, hectorite, stevensite, or the like). Further, illite, mica, vermiculite, talc, pyrophyllite, chlorite, or the like is used. Among the layered clay minerals, smectite and kaolinite having particularly greater cation exchange capacity are preferable and among these, smectite is more preferable.

A volume average particle diameter of the inorganic mineral may be from 0.2 μm to 1.5 μm and is preferably from 0.2 μm to 1.0 μm, in order that 80% or more of the entire inorganic mineral is easily present in a portion within 400 nm from the surface of the toner particle.

A method of measuring the volume average particle diameter of the inorganic mineral in the toner particle is as follows. A solvent, which may dissolve only a resin component of the toner without dissolving the inorganic mineral, and a toner are mixed with each other and stirred, so that the resin component of the toner is dissolved in the solvent, and then, solid-liquid separation is performed to obtain an inorganic mineral (herein, when an external additive is attached to the surface of the toner particle, the external additive attached to the surface of the toner particle is removed). Regarding the separated inorganic mineral, cumulative distributions by volume are drawn from the side of the smallest diameter with respect to particle size ranges (channels) divided based on the particle size distribution measured by a particle size distribution measuring device (COULTER MULTISIZER II (manufactured by Beckman Coulter K.K)), and the particle diameter when the cumulative percentage becomes 50% is defined as that corresponding to a volume average particle diameter. The volume average particle diameter is a sphere equivalent diameter.

The content of the inorganic mineral may be from 1% by weight to 10% by weight and is preferably 1% by weight to 5% by weight with respect to the entire toner particles, for example, in order to prevent occurrence of image deletion.

The weight ratio of the inorganic mineral to the release agent may be in a range of from 1:1 to 1:15.

In the toner of the exemplary embodiment, the "inorganic mineral present in a portion within 400 nm from the surface of the toner particle" is contained in the toner particle and does not include a so-called externally added inorganic mineral.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

If necessary, the colorant may be surface-treated or used in combination with a dispersing agent. Plural kinds of colorants may be used in combination.

The content of the colorant is, for example, preferably from 1% by weight to 30% by weight, and more preferably from 3% by weight to 15% by weight with respect to the entirety of the toner particles.

Other Additives

Examples of other additives include known additives such as a magnetic material, a charge-controlling agent, and an inorganic powder. The toner particles contain these additives as internal additives.

Characteristics of Toner Particle

The toner particle may be toner particle having a single-layer structure, or toner particles having a so-called core/shell structure composed of a core (core particle) and a coating layer (shell layer) coated on the core.

When the toner particle includes a core particle and a shell layer coated on the core particle, the shell layer may preferably contain the release agent and the inorganic mineral. When the shell layer may contain the release agent and the inorganic mineral, the release agent and the inorganic mineral are present in the surface portion of the toner particle, and accordingly, the release agent is prevented from being exposed on the surface of the toner particle and abrasion to the surface of the toner particle is easily prevented.

The toner particle may include a core particle, a first shell layer coated on the core particle, and a second shell layer coated on the first shell layer.

When the toner particle includes the core particle, the first shell layer coated on the core particle, and the second shell layer coated on the first shell layer, it is preferable that the first shell layer may contain the release agent and the second shell layer may contain the inorganic mineral.

When the first shell layer contains the release agent, the release agent is easily present in the surface portion of the toner particle and the release agent more easily bleeds to the surface of the toner particle at the time of toner fixation. The second shell layer coated on the first shell layer is present and the inorganic mineral is present in the second shell layer. Accordingly, the inorganic mineral is present on the surface side with respect to the release agent, and accordingly, the release agent is further prevented from being exposed on the surface of the toner particle and abrasion to the surface of the toner particle is further easily prevented. The inorganic mineral may be contained in both layers of the first shell layer and the second shell layer coated thereon.

The volume average particle size (D50v) of the toner particles is preferably from 2 μm to 10 μm, and more preferably from 4 μm to 8 μm.

Various average particle sizes and various particle size distribution indices of the toner particles are measured using a COULTER MULTISIZSER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle size of 2 μm to 60 μm is measured by a COULTER MULTISIZER II using an aperture having an aperture size of 100 μm. 50,000 particles are sampled.

Cumulative distributions by volume and by number are drawn from the side of the smallest size with respect to particle size ranges (channels) separated based on the measured particle size distribution. The particle size when the cumulative percentage becomes 16% is defined as that corresponding to a volume average particle size D16v and a number-average particle size D16p, while the particle size when the cumulative percentage becomes 50% is defined as that corresponding to a volume average particle size D50v and a number-average particle size D50p. Furthermore, the particle size when the cumulative percentage becomes 84% is defined as that corresponding to a volume average particle size D84v and a number-average particle size D84p.

Using these, a volume average particle size distribution index (GSDv) is calculated as $(D84v/D16v)^{1/2}$, while a number-average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

$$SF1=(ML^2/A)\times(\pi/4)\times 100 \quad \text{Expression:}$$

In the foregoing expression, ML represents an absolute maximum length of a toner, and A represents a projected area of a toner.

Specifically, the shape factor SF1 is numerically converted mainly by analyzing a microscopic image or a scanning electron microscopic (SEM) image by using of an image analyzer, and is calculated as follows. That is, an optical microscopic image of particles scattered on a surface of a glass slide is input to an image analyzer LUZEX through a video camera to obtain maximum lengths and projected areas of 100 particles, values of SF1 are calculated through the foregoing expression, and an average value thereof is obtained.

In the toner particle of the toner according to the exemplary embodiment, the presence ratio (400 nm) of the release agent is equal to or greater than 80%. The presence ratio (400 nm) of the release agent is preferably from 85% to 100% and more preferably from 90% to 100%. The presence ratio (400 nm) of the release agent is preferably in the range described above, in a viewpoint of peeling properties of a fixed image from the fixing member.

As a method of controlling the presence ratio (400 nm) of the release agent to be equal to or greater than 80%, a method of setting the toner particle to have a core/shell structure and using a release agent when forming a shell is used, for example.

In the toner particle of the toner according to the exemplary embodiment, the presence ratio (400 nm) of the inorganic mineral (that is, percentage of the inorganic mineral present in a portion within 400 nm from the surface of the toner particle) is equal to or greater than 80%. The presence ratio of the inorganic mineral is preferably from 85% to 100% and more preferably from 90% to 100%, in order to further prevent image deletion.

The percentage of the inorganic mineral present in a portion within 300 nm from the surface of the toner particle (hereinafter, also referred to as the presence ratio (300 nm) of the inorganic mineral") is preferably equal to or greater than 80%, more preferably from 85% to 100%, and even more preferably from 90% to 100%. The percentage of the inorganic mineral present in a portion within 225 nm from the surface of the toner particle (hereinafter, also referred to as the presence ratio (225 nm) of the inorganic mineral") is preferably equal to or greater than 80%, more preferably from 85% to 100%, and even more preferably from 90% to 100%.

Meanwhile, it is preferable that the percentage of the release agent present in a portion within 300 nm from the surface of the toner particle is equal to or smaller than 20% (more preferably from 0% to 10% and even more preferably 0% to 5%). Hereinafter, the percentage of the release agent present in a portion within 300 nm from the surface of the toner particle is also referred to as a "presence ratio (300 nm) of the release agent".

In order to further prevent image deletion, it is particularly preferable that a larger amount of the inorganic mineral is present on a surface side of the toner particle than an amount of the release agent present in a portion within 400 nm from the surface of the toner particle.

Since a larger amount of the inorganic mineral is present on a surface side of the toner particle than an amount of the release agent present in a portion within 400 nm from the surface of the toner particle, the strength of the toner particle is more easily improved.

From such a viewpoint, it is preferable that, in the toner of the exemplary embodiment, 20% or less (more preferably 0% to 10% and even more preferably 0% to 5%) of the entire release agent is present in a portion within 300 nm from the surface of the toner particle and 80% or more (more preferably 85% to 100% and even more preferably 90% to 100%) of the entire inorganic mineral is present in a portion within 300 nm from the surface of the toner particle.

As a method of controlling the presence ratio (400 nm) of the inorganic mineral to be equal to or greater than 80%, a method of setting the toner particle to have a core/shell structure and using the inorganic mineral when forming a shell is used, for example. As a method of controlling the presence ratio (300 nm) of the inorganic mineral (or presence ratio (225 nm) of the inorganic mineral) to be equal to or greater than 80%, a method of setting the toner particle to have a core/first shell/second shell structure and using the inorganic mineral when forming a second shell is used, for example.

As a method of controlling the presence ratio (300 nm) of the release agent to be equal to or less than 20%, a method of setting the toner particle to have a core/first shell/second shell structure and using the release agent when forming a first shell and not using the release agent when forming a second shell is used, for example.

In the toner particle of the toner according to the exemplary embodiment, it is preferable that the release agent domain satisfying Condition (1) to Condition (4) described below (hereinafter, the release agent domain satisfying Condition (1) to Condition (4) described below may be referred to as a "specific release agent domain") is formed, from a viewpoint of peeling properties of a fixed image from the fixing member.

Condition (1): a length of the release agent domain in a long axis direction is from 300 nm to 1200 nm Condition (2): a ratio between a length of the release agent domain in a long axis direction and a length thereof in a short axis direction (length in a long axis direction/length in a short axis direction) is from 3.0 to 15.0

Condition (3): an angle formed by a tangent line passing a tangent point of a circumference of a circle centered at a centroid of the release agent domain and inscribed in an outer edge of the toner particle and the outer edge, and a line which passes the centroid of the release agent domain and extends in the long axis direction of the release agent domain is from 0° to 45°

Condition (4): a ratio between a circle equivalent diameter of the toner particle and a distance A between the centroid of the release agent domain and the tangent point (distance A/circle equivalent diameter) is from 0.03 to 0.25

It is assumed that the release agent domain satisfying Condition (1) to Condition (4) described above exhibits the following effects.

When the release agent domain satisfies Condition (1), it is easy to ensure an amount of the release agent which is necessary for causing the release agent to bleed from the release agent domain to exhibit releasing properties.

When the release agent domain satisfies Condition (2), a contact area of the release agent domain elongated in the long axis direction with a sheet at the time of fixing is increased and it is easy to increase an amount of the release agent.

When the release agent domain satisfies Condition (3), the contact area with the sheet is further increased at the time of fixing, and accordingly, the release agent effectively easily bleeds out at the time of fixing.

When the release agent domain satisfies Condition (4), the release agent domain is arranged in the surface portion of the toner particle, and accordingly, the release agent bled from the release agent domain easily bleeds out to the external portion of the toner particle.

Herein, a relationship between the toner particle and the release agent domain will be described with reference to the drawing.

FIG. 1 is a diagram showing a cross section of the toner particle according to the exemplary embodiment. In FIG. 1, a toner particle 100 includes plural release agent domains 102. A circle which is centered at a centroid B of the release agent domain 102 and inscribed in an outer edge of the toner particle 100 is shown as a circle C in FIG. 1. A radius of the circle C, that is, a distance between a tangent point at which the outer edge of the toner particle 100 and the circle C are inscribed, and the centroid B is set as a distance A. A line which passes the centroid B of the release agent domain 102 and extends in the long axis direction of the release agent domain 102 is set as a line D. A tangent line which passes a tangent point of the circumference of the circle C and the outer edge of the toner particle 100 is set as a line E. An angle (acute angle) formed by the line D and the line E is set as θ. When θ is 0°, it shows that the line D and the line E does not intersect with each other.

In the exemplary embodiment, the presence ratio of the release agent contained in the toner particle and the presence ratio of the inorganic mineral contained in the toner particle are calculated by observing the cross section of the toner particle and the observation of the specific release agent domain contained in the toner particle is performed using the cross section of the toner particle.

The cross section of the toner particle is, for example, checked by a method of observing the cross section of the toner particle using a transmission electron microscope (TEM) or a method of dying the cross section of the toner particle with ruthenium tetroxide and observing the cross section thereof using a scanning electron microscope (SEM). In order to more clearly observe the release agent domain of the cross section of the toner, a method of observing the cross section thereof with a scanning electron microscope is preferably used. As the scanning electron microscope, any scanning electron microscope which is well known by a person skilled in the art may be used, and for example, SU8020 manufactured by Hitachi High-Technologies Corporation or JSM-7500F manufactured by JEOL, Ltd. is used.

The preparation of a measurement sample for observing the cross section of the toner particle is performed with the following procedure. A toner particle to be measured is embedded in an epoxy resin, and then the epoxy resin is cured. The cured substance is cut into a thin section with a microtome including a diamond blade (for example, ULTRACUT UCT manufactured by Leica), thereby obtaining a measurement sample in which a cross section of the toner is exposed.

In a case where an external additive is attached to the surface of the toner particle when obtaining the measurement sample, the external additive attached to the surface of the toner particle is removed. Specifically, several droplets of a surfactant such as contamination (manufactured by Wako Pure Chemical Industries, Ltd.) is added to ion exchange water, the toner is added thereto and dispersed, the resultant material is irradiated with ultrasonic waves for 1 minute to 5 minutes, and thereby the external additive attached to the surface of the toner particle is removed. After that, a dispersion of the toner particle passes through filter paper and subjected to rinse cleaning, and the toner particles on the filter paper are dried to obtain toner particles for preparing the measurement sample.

A method of measuring the presence ratio (400 nm) of the release agent and the presence ratio (300 nm) of the release agent will be described.

The thin measurement sample prepared as described above in which a cross section of the toner is exposed is dyed with ruthenium tetroxide, an SEM image of the cross section of the toner particle is obtained with a scanning electron microscope and the cross section of the toner particle is observed. With the method, each component in the cross section of the toner article is identified by a difference in shading caused by the degree of dyeing, and the release agent is observed.

In the SEM image, the cross section of the toner particle having a maximum length which is 85% or more of a volume average particle diameter of the toner particles is selected, the domain of the dyed release agent is observed, the area of the release agent of the entire toner particle and the area of the release agent present in an area within 400 nm (or within 300 nm) from the surface of the toner particle are determined, and a ratio of both areas (area of the release agent present in an area within 400 nm (or within 300 nm) from the surface of the toner particle/area of the release agent of the entire toner particle) is calculated. This calculation is performed for 100 toner particles which are arbitrarily selected, and an average value thereof is set as the presence ratio of the release agent.

The reason for selecting the cross section of the toner particle having a maximum length which is 85% or more of a volume average particle diameter of the toner particles is as follows. Since the toner is a three-dimensional shape and the SEM image is a cross section, the end portion may be cut and the cross section of the end portion does not reflect the domain of the release agent of the toner.

The presence ratio (400 nm) of the inorganic mineral and the presence ratio (300 nm) of the inorganic mineral will be described.

An SEM image of the measurement sample prepared as described above in which a cross section of the toner is exposed is obtained. Element analysis of the measurement sample of the cross section of the toner particle is performed using an energy dispersive X-ray analyzer (SEM-EDX device) attached to a scanning electron microscope, and each presence ratio of each inorganic mineral is measured by a mapping process.

Regarding each presence ratio of the inorganic mineral, an area of the inorganic mineral of the entire toner particle and an area of the inorganic mineral present in an area within 400 nm (within or 300 nm) from the surface of the toner particle are determined, and a ratio of both areas (area of the inorganic mineral present in an area within 400 nm (or within 300 nm) from the surface of the toner particle/area of the inorganic mineral of the entire toner particle) is calculated. This calculation is performed for 100 toner particles which are arbitrarily selected, and an average value thereof is set as the presence ratio of each inorganic mineral.

The observation of the cross section of the specific release agent domain will be described.

A method of determining an angle formed by a tangent line passing a tangent point of a circumference of a circle centered at a centroid of the release agent domain and inscribed in an outer edge of the toner particle and the outer edge, and a line which passes the centroid of the release agent domain and extends in the long axis direction of the release agent domain will be described.

An image is recorded at magnification which allows a cross section of one toner particle to come in sight. Image analysis for the recorded image is performed under a condition of 0.010000 μm/pixel by using image analysis software (WINROOF manufactured by MITANI Corporation). An image of the cross section of the toner may be observed by this image analysis by using a brightness difference (contrast) between the epoxy resin used in embedding and the binder resin of the toner. A long axis length of the release agent domain in the toner and an aspect ratio thereof are determined based on the observed image.

Subsequently, a centroid position of the release agent domain extracted by using a brightness difference (contrast) between the binder resin and the release agent is obtained as follows. x coordinates of the centroids are values obtained by dividing summation of respective $x_i$ coordinate values by n, and y coordinates of the centroids are values obtained by dividing summation of respective $y_i$ coordinate values by n, when the number of pixels in an area of the extracted toner or the extracted release agent domain is set as n, xy coordinates of each pixel are set as $x_i$ and $y_i$ (i=1, 2, . . . , n).

An angle formed by a tangent line passing a tangent point of a circumference of a circle centered at a centroid of the release agent domain and inscribed in an outer edge of the toner particle and the outer edge, and a line which passes the centroid of the release agent domain and extends in the long axis direction of the release agent domain is determined from the determined centroid and the observed image.

In the exemplary embodiment, a percentage of the toner particles including the specific release agent domains in the entire toner particles is preferably equal to or greater than 30 number %, more preferably equal to or greater than 40 number %, and even more preferably equal to or greater than 50 number %, from a viewpoint of peeling properties of a fixed image from a fixing member. It is more preferable that the percentage of the toner particles including the specific release agent domains in the entire toner particles is equal to or greater than 30 number %, from a viewpoint of peeling properties of a fixed image from a fixing member.

In the exemplary embodiment, the number of toner particles to be evaluated when calculating the percentage of the toner particles including the specific release agent domains in the entire toner particles is 100 or more.

The adjustment of the percentage of the toner particles including the specific release agent domains in the entire toner particles may be performed by adjusting the position of the release agent in the process of forming the toner particle and causing the release agent domain to grow by heating.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Surfaces of the inorganic particles as an external additive are preferably subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, PMMA, and melamine resin particles) and a cleaning aid (e.g., metal salt of higher fatty acid represented by zinc stearate, and fluorine-based polymer particles).

The amount of the external additive externally added is, for example, preferably from 0.01% by weight to 5% by weight, and more preferably from 0.01% by weight to 2.0% by weight with respect to the toner particles.

Toner Preparing Method

Next, a method of preparing a toner according to this exemplary embodiment will be described.

The toner according to this exemplary embodiment is obtained by externally adding an external additive to toner particles after preparing of the toner particles.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles are preferably obtained by an aggregation and coalescence method.

Specifically, for example, when the toner particles are manufactured by an aggregation and coalescence method, the toner particles are manufactured through the processes of: preparing a resin particle dispersion in which resin particles as a binder resin are dispersed (resin particle dispersion preparation process); aggregating each of the resin particles (if necessary, other particles) in the resin particle dispersion (if necessary, in a dispersion after mixing with other particle dispersions) to form aggregated particles (aggregated particle forming process); and heating the aggregated particle dispersion in which the aggregated particles are dispersed, to coalesce the aggregated particles, thereby forming toner particles (coalescence process).

Hereinafter, the respective processes will be described in detail.

In the following description, a method of obtaining toner particle containing a colorant and a release agent will be described, but the colorant is used if necessary. Additives other than the colorant may be used.

Resin Particle Dispersion Preparation Process

First, for example, a colorant particle dispersion in which colorant particles are dispersed and a release agent particle dispersion in which release agent particles are dispersed are prepared together with a resin particle dispersion in which resin particles as a binder resin are dispersed.

Herein, the resin particle dispersion is prepared by, for example, dispersing resin particles by a surfactant in a dispersion medium.

Examples of the dispersion medium used for the resin particle dispersion include aqueous mediums.

Examples of the aqueous mediums include water such as distilled water and ion exchange water, and alcohols. These may be used alone or in combination of two or more kinds thereof.

Examples of the surfactant include anionic surfactants such as sulfuric ester salt, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a Dyne mill having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

A volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) divided using the particle size distribution obtained by the measurement with a laser diffraction-type particle size distribution measuring device (for example, LA-700 manufactured by Horiba, Ltd.), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Process

Next, the colorant particle dispersion and the release agent particle dispersion are mixed together with the resin particle dispersion.

The resin particles, the colorant particles, the release agent particles are heterogeneously aggregated in the mixed dispersion, thereby forming aggregated particles having a diameter near a target toner particle diameter and including the resin particles, colorant particles, and the release agent particles.

Specifically, for example, an aggregating agent is added to the mixed dispersion and a pH of the mixed dispersion is adjusted to acidity (for example, the pH is from 2 to 5). If necessary, a dispersion stabilizer is added. Then, the mixed dispersion is heated at a temperature of the glass transition temperature of the resin particles (specifically, for example, from a temperature 30° C. lower than the glass transition temperature of the resin particles to a temperature 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the mixed dispersion using a rotary shearing-type homogenizer, the pH of the mixed dispersion may be adjusted to acidic (for example, the pH is from 2 to 5), a dispersion stabilizer may be added if necessary, and the heating may then be performed.

Examples of the aggregating agent include a surfactant having an opposite polarity to the polarity of the surfactant used as the dispersing agent to be added to the mixed dispersion, such as inorganic metal salts and di- or higher-valent metal complexes. Particularly, when a metal complex is used as the aggregating agent, the amount of the surfactant used is reduced and charging characteristics are improved.

If necessary, an additive may be used which forms a complex or a similar bond with the metal ions of the aggregating agent. A chelating agent is preferably used as the additive.

Examples of the inorganic metal salt include a metal salt such as calcium chloride, calcium nitrate, barium chloride, magnesium chloride, zinc chloride, aluminum chloride, and aluminum sulfate, and inorganic metal salt polymer such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

An addition amount of the chelating agent is, for example, preferably in a range of from 0.01 parts by weight to 5.0 parts by weight, and more preferably in a range of from 0.1 parts by weight to less than 3.0 parts by weight relative to 100 parts by weight of the resin particles.

Coalescence Process

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

The toner particles are obtained through the above-described processes.

The toner particles may be prepared through the processes of: after the aggregated particle dispersion in which the aggregated particles are dispersed is obtained, further mixing the aggregated particle dispersion with a resin particle dispersion in which resin particles are dispersed to perform aggregation so that the resin particles further adhere to the surfaces of the aggregated particles, thereby forming second aggregated particles; and coalescing the second aggregated particles by heating the second aggregated particle dispersion in which the second aggregated particles are dispersed, and thereby forming toner particles having a core/shell structure.

When preparing toner particles having a core/shell structure, in the process of forming the second aggregated particles, the aggregated particle dispersion, the resin particle dispersion in which the resin particles are dispersed, the release agent particle dispersion in which release agent particles are dispersed, and the inorganic mineral may be further mixed with each other to perform aggregation so that the resin particles, the release agent particles, and the inorganic mineral further adhere to the surfaces of the aggregated particles.

In addition, a toner particle including a core particle, a first shell layer coated on the core particle, and a second shell layer coated on the first shell layer may be prepared. In this case, toner particles may be prepared through the processes of: after obtaining the aggregated particle dispersion in which the aggregated particles are dispersed, further mixing the aggregated particle dispersion, a resin particle dispersion in which resin particles are dispersed, and a release agent particle dispersion in which release agent particles are dispersed with each other to perform aggregation so that the resin particles and the release agent particles further adhere to the surfaces of the aggregated particles, thereby forming third aggregated particles; further mixing the third aggregated particle dispersion, the resin particle dispersion in which the resin particles are dispersed, and the inorganic mineral with each other to perform aggregation so that the resin particles and the inorganic mineral further adhere to the surfaces of the third aggregated particles, thereby forming fourth aggregated particles; and coalescing the fourth aggregated particles by heating a fourth aggregated particle dispersion in which the fourth aggregated particles are dispersed, and thereby forming toner particles having a core/first shell/second shell structure. In the process of forming the third aggregated particles described above, the inorganic mineral may be further incorporated (that is, the inorganic mineral may be further incorporated in both processes of forming the third aggregated particles and forming the fourth aggregated particles). The inorganic mineral mixed in each process described above may be mixed as an inorganic mineral dispersion by preparing the inorganic mineral dispersion in which the inorganic mineral is dispersed.

For controlling of arrangement of the release agent domains, a method of temporarily performing cooling after forming the toner particles having a core/first shell/second shell structure, and then increasing the temperature to a melting temperature of the release agent is used. By performing cooling and increasing the temperature to a melting temperature of the release agent in a state where the release agent particles contained in the first shell is interposed between binder resin particles contained in the core and binder resin particles contained in the second shell, the release agent domains slowly grow in the first shell and a growth direction of the domains is easily oriented to a shell layer direction. As a result, it is possible to control the growth direction of the release agent domains and it is easy to satisfy the specific release agent domains.

After the coalescence process is ended, toner particles formed in a solution are subjected to a well-known washing process, a well-known solid-liquid separation process, a well-known drying process, and thereby dried toner particles are obtained.

Regarding the washing process, replacing washing using ion exchanged water may preferably be sufficiently performed for charging property. The solid-liquid separation process is not particularly limited, but suction filtration, pressure filtration, or the like may preferably be performed for productivity. The drying process is not particularly limited, but freeze drying, flash jet drying, fluidized drying, vibrating fluidized drying, and the like may preferably be performed for productivity.

The toner according to the exemplary embodiment is prepared, for example, by adding an external additive to the obtained toner particles in a dried state, and performing mixing. The mixing may be performed, for example, by using a V blender, a HENSCHEL mixer, a LÖDIGE mixer, or the like. Furthermore, if necessary, coarse toner particles may be removed using a vibration sieving machine, a wind classifier, or the like.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores and coated with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic ester copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive particles.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved or dispersed in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to forma toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging process of charging a surface of an image holding member, an electrostatic charge image forming process of forming an electrostatic charge image on a charged surface of the image holding member, a developing process of developing the electrostatic charge image formed on the surface of the image holding member with the electrostatic charge image developer according to this exemplary embodiment to form a toner image, a transfer process of transferring the toner image formed on the surface of the image holding member onto a surface of a recording medium, and a fixing process of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans a surface of an image holding member after transfer of a toner image and before charging; or an apparatus that is provided with an erasing unit that irradiates, after transfer of a toner image and before charging, a surface of an image holding member with erasing light for erasing.

In the case of an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that stores the electrostatic charge image developer according to this exemplary embodiment and is provided with a developing unit is preferably used.

Hereinafter, an example of the image forming apparatus according to this exemplary embodiment will be shown. However, this image forming apparatus is not limited thereto. Major parts shown in the drawing will be described, but descriptions of other parts will be omitted.

Figure 2:
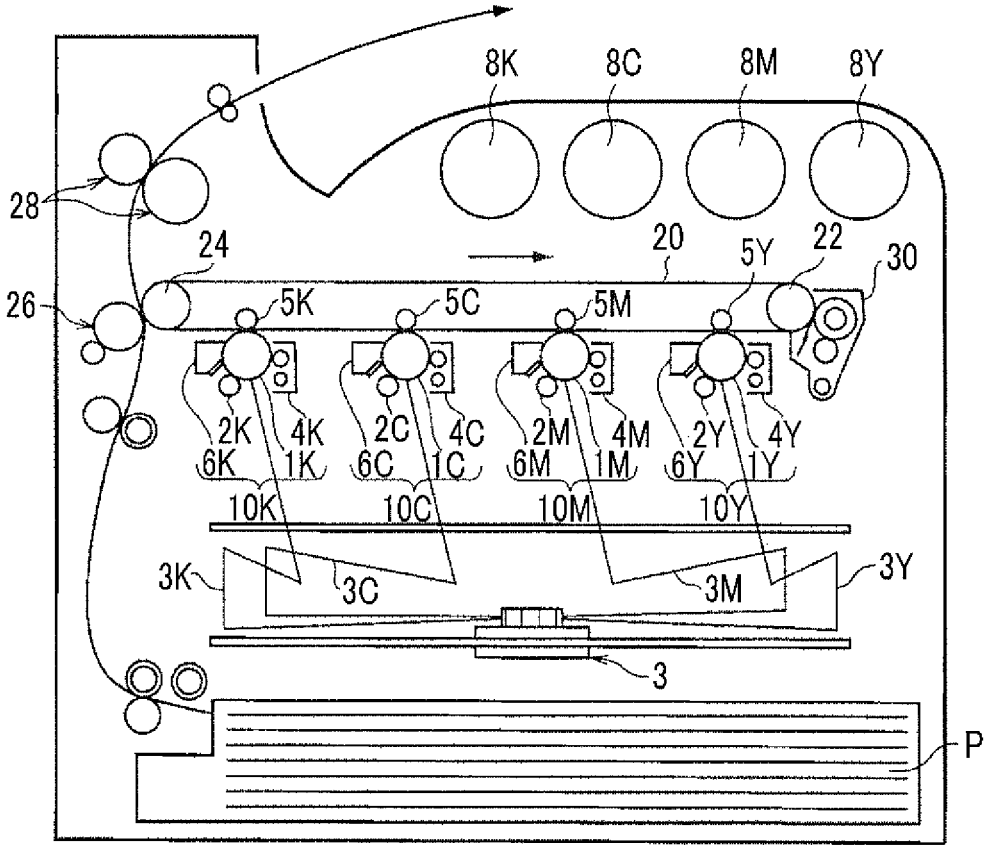
FIG. 2 is a schematic configuration diagram showing an image forming apparatus according to the exemplary embodiment.

FIG. 2 is a schematic diagram showing a configuration of the image forming apparatus according to this exemplary embodiment.

The image forming apparatus shown in FIG. 2 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner stored in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative electrostatic charge image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y stores, for example, an electrostatic charge image developer including at least a yellow toner and a carrier. The yellow toner is frictionally charged by being agitated in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased electrostatic charge image part on the surface of the photoreceptor 1Y, whereby the electrostatic charge image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copiers, printers, and the like. As a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to this exemplary embodiment will be described.

The process cartridge according to this exemplary embodiment is provided with a developing unit that stores the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawing will be described, but descriptions of other parts will be omitted.

Figure 3:
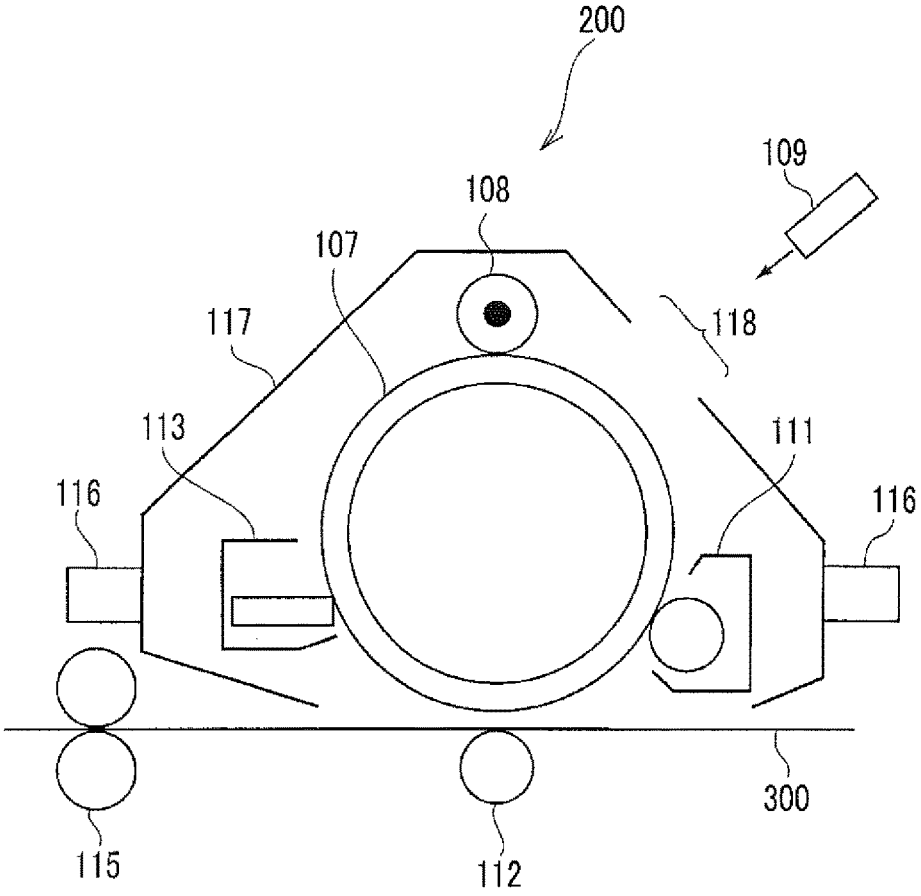
FIG. 3 is a schematic configuration diagram showing an example of a process cartridge according to the exemplary embodiment.

FIG. 3 is a schematic diagram showing a configuration of the process cartridge according to this exemplary embodiment.

A process cartridge 200 shown in FIG. 3 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 3, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment stores the toner according to this exemplary embodiment and is detachable from an image forming apparatus. The toner cartridge stores a toner in a storing portion for replenishment for being supplied to the developing unit provided in the image forming apparatus.

The image forming apparatus shown in FIG. 2 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, when the toner stored in the toner cartridge runs low, the toner cartridge is replaced.

EXAMPLES

Hereinafter, the exemplary embodiment will be described more specifically using examples and comparative examples, but the exemplary embodiment is not limited to these examples. Unless specifically noted, "parts" and "%" are based on weight.

| Preparation of Polyester Resin (1) | |
|---|---|
| 2 mol adduct of ethylene oxide of bisphenol A: | 114 parts |
| 2 mol adduct of propylene oxide of bisphenol A: | 84 parts |

-continued

| Preparation of Polyester Resin (1) | |
|---|---|
| Dimethylester terephthalate: | 75 parts |
| Dodecenyl succinic acid: | 19.5 parts |
| Trimellitic acid: | 7.5 parts |

The above components are put into a 5-liter flask including a stirrer, a nitrogen gas introducing tube, a temperature sensor, and a rectifier, heated to a temperature of 190° C. over 1 hour, and stirring is performed in a reaction system, and 3.0 parts of dibutyl tin oxide is put therein. The temperature is increased to 240° C. from 190° C. over 6 hours while distilling away generated water, a dehydration condensation reaction is further continued at 240° C. for 2 hours, and thus, a polyester resin (1) is synthesized.

Regarding the obtained polyester resin (1), a glass transition temperature is 54° C., an acid value is 15.3 mgKOH/g, a weight average molecular weight is 58,000, and a number average molecular weight is 5,600.

| Preparation of Polyester Resin Particle Dispersion (1) | |
|---|---|
| Polyester resin (1) (Mw: 58,000): | 144 parts |
| Isopropyl acrylamide (manufactured by Kohjin Film & Chemicals Co., Ltd.): | 16 parts |
| Ethyl acetate: | 233 parts |
| Sodium hydroxide aqueous solution (0.3 N): | 0.1 parts |

The above components are put in a 1000-mL separable flask, heated at 70° C., and stirred with a Three-One Motor (manufactured by Shinto Scientific Co., Ltd.) to prepare a resin mixed liquid. 373 parts of the ion exchange water is slowly added therein while further stirring the resin mixed liquid, to thereby perform phase inversion emulsification, and the solvent thereof is removed to obtain a polyester resin particle dispersion (1) (solid content concentration: 30%). A volume average particle diameter of the resin particles in the dispersion is 160 nm.

| Preparation of release agent particle dispersion (1) | |
|---|---|
| Fischer Tropsch wax (melting temperature of 92° C., manufactured by Nippon Seiro Co., Ltd.): | 180 parts |
| Anionic surfactant (NEOGEN R manufactured by Dai-Ichi Kogyo Seiyaku Co., Ltd.): | 4.5 parts |
| Ion exchange water: | 410 parts |

The above components are heated at 110° C. and dispersed using a homogenizer (ULTRA TURRAX T50 manufactured by IKA Japan, K.K.). After that, the mixture is subjected to dispersion treatment with MANTON-GAULIN high pressure homogenizer (manufactured by Gaulin Co., Ltd.), to thereby disperse release agent particles having a volume average particle diameter of 0.24 μm, and the concentration is adjusted using ion exchange water, and thus, a release agent particle dispersion (1) in which solid concentration of the release agent particles is 30.0% by weight is prepared.

Preparation of Release Agent Particle Dispersion (2)

A release agent particle dispersion (2) in which solid concentration of the release agent particles is 30.0% by weight is prepared in the same manner as in the preparation of the release agent particle dispersion (1), except for using paraffin wax HNP0190 (melting temperature of 85° C., manufactured by Nippon Seiro Co., Ltd.) instead of Fischer Tropsch wax used in the preparation of the release agent particle dispersion (1).

Preparation of Release Agent Particle Dispersion (3)

A release agent particle dispersion (3) in which solid concentration of the release agent particles is 30.0% by weight is prepared in the same manner as in the preparation of the release agent particle dispersion (1), except for using polyethylene wax POLYWAX725 (melting temperature of 104° C., manufactured by Baker Petrolite Corporation) instead of Fischer Tropsch wax used in the preparation of the release agent particle dispersion (1).

| Preparation of Colorant Particle Dispersion | |
|---|---|
| C.I. Pigment Red 238 (FUJI FAST CARMINE 580 manufactured by Fuji Pigment Co., Ltd.): | 250 parts |
| Anionic surfactant (NEOGEN SC manufactured by Dai-Ichi Kogyo Seiyaku Co., Ltd.): (60% of active ingredient, 8% with respect to the colorant) | 33 parts |
| Ion exchange water: | 750 parts |

280 parts of ion exchange water and 33 parts of anionic surfactant are put in a stainless steel vessel having such a size that a height of a liquid surface when all of the above components are put therein is approximately ⅓ of the height of the vessel, the surfactant is sufficiently dissolved, the pigments are all put therein, the resultant material is stirred using a stirrer until no unwet pigments remain, and sufficiently defoamed. The remaining ion exchange water is added thereto after the defoaming, the resultant material is dispersed by using a homogenizer (ULTRA TURRAX T50 manufactured by IKA Japan, K.K.) at 5,000 rpm for 10 minutes, is stirred and defoamed using the stirrer for 24 hours. After the defoaming, the resultant material is dispersed again by using the homogenizer at 6,000 rpm for 10 minutes, is stirred and defoamed using the stirrer for 24 hours. Then, the dispersion is dispersed by using a high pressure impact type dispersing machine ULTIMIZER (HJP30006 manufactured by Sugino Machine, Ltd.) at a pressure of 240 MPa. The dispersion is performed with about 25 passes based on the conversion from the total introduction amount and processing capacity of the device. The obtained dispersion is allowed to stand for 72 hours to remove precipitates, ion exchange water is added to provide a solid content concentration of 20%. A volume average particle diameter D50 of the particles in the colorant particle dispersion is 135 nm.

| Preparation of Inorganic Mineral Dispersion (1) | |
|---|---|
| Smectite (bentonite product "ODOSORUBU" manufactured by Kurosaki Hakudo Kogyo KK.): | 40 parts |
| Anionic surfactant (NEOGEN R manufactured by Dai-Ichi Kogyo Seiyaku Co., Ltd.): | 4.0 parts |
| Ion exchange water: | 396 parts |

The above components are dispersed using a homogenizer (ULTRA TURRAX T50 manufactured by IKA Japan, K.K.) at room temperature. After that, the mixture is subjected to dispersion treatment with MANTON-GAULIN high pressure homogenizer (manufactured by Gaulin Co., Ltd.), inorganic mineral particles having a volume average particle diameter of 0.50 μm are dispersed therein, and the concentration is adjusted using ion exchange water, to thereby prepare an inorganic mineral dispersion (1) in which solid concentration of the inorganic mineral is 10.0% by weight.

Preparation of Inorganic Mineral Dispersion (2)

An inorganic mineral dispersion (2) in which solid concentration of the inorganic mineral is 10.0% by weight is prepared in the same manner as in the preparation of the inorganic mineral dispersion (1), except for using kaolinite (product name: STATINTONE No. 5 manufactured by Takehara Kagaku Kogyo Co., Ltd.) instead of smectite used in the preparation of the inorganic mineral dispersion (1).

Example 1

| Preparation of Toner (1) | |
|---|---|
| Ion exchange water: | 215 parts |
| Polyester resin particle dispersion (1): | 203 parts |
| Colorant particle dispersion: (solid content of 20%) | 20 parts |
| Anionic surfactant: (NEOGEN RK manufactured by Dai-Ichi Kogyo Seiyaku Co., Ltd., 20%) | 2.8 parts |

The above components are put in a 3-liter reaction vessel including a thermometer, a pH meter, and a stirrer, and maintained at 30° C. and a stirring rotation rate of 150 rpm for 30 minutes, while controlling a temperature with a mantle heater from the outside. After that, 0.3 N nitric acid aqueous solution is added to thereby adjust the pH in the aggregation process to 3.0.

A polyaluminium chloride aqueous solution in which 0.7 parts of polyaluminium chloride is dissolved in 7 parts of ion exchange water is added to the mixture, while dispersing with a homogenizer (ULTRA TURRAX T50 manufactured by IKA Japan, K.K.). After that, the temperature is increased to 50° C. while stirring, a particle diameter is measured using a COULTER MULTISIZER II (aperture diameter: 50 μm, manufactured by Beckman Coulter, Inc.), and a volume average particle diameter is adjusted to 5.0 μm. Then, a mixed solution of 30 parts of the polyester resin particle dispersion (1) and 15 parts of the release agent particle dispersion (1) is added. After 30 minutes, 45 parts of the polyester resin particle dispersion (1) and 20 parts of the inorganic mineral dispersion (1) as the inorganic mineral are further added, so that the resin particles and the inorganic minerals are attached (shell structure) to the surfaces of the aggregated particles.

After adding 20 parts of 10% by weight nitrilotriacetic acid (NTA) metal salt solution (CHELEST 70 manufactured by Chelest Corporation), the pH is adjusted to 9.0 using 1 N sodium hydroxide aqueous solution. Then, the temperature is increased to 90° C. by setting a rate of temperature increase at 0.05° C./min, the temperature is maintained at 90° C. for 3 hours, and then the mixture is cooled. After that, in order to cause the release agent domains to grow, the resultant material is heated to 92° C. which is a temperature equal to or higher than the melting temperature of the release agent and maintained for 30 minutes, slowly cooled to 30° C. at a rate of 2° C./min, and filtered to obtain coarse toner particles. This is further re-dispersed in ion exchange water, and filtered, the cycle of the re-dispersion and filtration is repeated to perform washing until electric conductivity of the filtrate becomes equal to or smaller than 20 μS/cm, and the resultant material is subjected to vacuum-drying in an oven at 40° C. for 5 hours, and thus, toner particles (1) are obtained.

1.5 parts by weight of hydrophobic silica (RY50 manufactured by Nippon Aerosil Co. Ltd.) and 1.0 part by weight of hydrophobic titanium oxide (T805 manufactured by Nippon Aerosil Co. Ltd.) are mixed with respect to 100 parts by weight of the obtained toner particles (1) using a sample mill at 10,000 rpm for 30 seconds. After that, the mixture is sieved by a vibration sieving device having an aperture of 45 μm, and thus, a toner (1) is prepared. A volume average particle diameter of the obtained toner (1) is 6.1 μm.

Example 2

Preparation of Toner (2)

Toner particles (2) and a toner (2) are obtained in the same manner as in the preparation of the toner (1), except for changing the kind of the inorganic mineral to the inorganic mineral dispersion (2) according to Table 1.

Example 3

Preparation of Toner (3)

After performing the aggregation process in the same manner as in the preparation of the toner (1), the temperature is increased to 50° C., a particle diameter is measured using COULTER MULTISIZER II, and a volume average particle diameter is adjusted to 5.0 μm. Then, a toner (3) is prepared in the same manner as in the preparation of the toner (1), except for changing the addition of the mixed solution of 30 parts of the polyester resin particle dispersion (1) and 15 parts of the release agent particle dispersion (1) in the preparation of the toner (1) to addition of a mixed solution of 35 parts of the polyester resin particle dispersion (1) and 10 parts of the release agent particle dispersion (1).

Example 4

Preparation of Toner (4)

After performing the aggregation process in the same manner as in the preparation of the toner (1), the temperature is increased to 50° C., a particle diameter is measured using COULTER MULTISIZER II, and a volume average particle diameter is adjusted to 5.0 μm. Then, a toner (4) is prepared in the same manner as in the preparation of the toner (1), except for changing the addition of the mixed solution of 30 parts of the polyester resin particle dispersion (1) and 15 parts of the release agent particle dispersion (1) in the preparation of the toner (1) to addition of a mixed solution of 25 parts of the polyester resin particle dispersion (1) and 20 parts of the release agent particle dispersion (1).

Example 5

Preparation of Toner (5)

The release agent particle dispersion (1) used in the preparation of the toner (1) is changed to the release agent particle dispersion (2). A toner (5) is prepared in the same manner as in the preparation of the toner (1), except for changing the heating to 92° C. which is a temperature equal to or higher than the melting temperature of the release agent to the heating to 85° C. which is a temperature equal to or higher than the melting temperature of the release agent after performing the aggregation process in the same manner as in the preparation of the toner (1).

Example 6

Preparation of Toner (6)

The release agent particle dispersion (1) used in the preparation of the toner (1) is changed to the release agent particle dispersion (3). A toner (6) is prepared in the same manner as in the preparation of the toner (1), except for changing the heating to 92° C. which is a temperature equal to or higher than the melting temperature of the release agent to the heating to 104° C. which is a temperature equal to or higher than the melting temperature of the release agent after performing the aggregation process in the same manner as in the preparation of the toner (1).

Example 7

Preparation of Toner (7)

After performing the aggregation process in the same manner as in the preparation of the toner (1), the temperature is increased to 50° C., a particle diameter is measured using COULTER MULTISIZER II, and a volume average particle diameter is adjusted to 5.0 μm. Then, a mixed solution of 30 parts of the polyester resin particle dispersion (1) and 15 parts of the release agent particle dispersion (1) is added. A toner (7) is prepared in the same manner as in the preparation of the toner (1), except for changing the addition of 45 parts of the polyester resin particle dispersion (1) and 20 parts of the inorganic mineral dispersion (1) as the inorganic mineral which is performed 30 minutes after the previous addition, to addition of 75 parts of the polyester resin particle dispersion (1), 15 parts of the release agent particle dispersion (1), and 20 parts of the inorganic mineral dispersion (1).

Example 8

| Preparation of Toner (8) | |
|---|---|
| Ion exchange water: | 215 parts |
| Polyester resin particle dispersion (1): | 237 parts |
| Colorant particle dispersion: (solid content of 2096) | 20 parts |
| Anionic surfactant (NEOGEN RK manufactured by Dai-Ichi Kogyo Seiyaku Co., Ltd., 20%): | 2.8 parts |

The above components are put in a 3-liter reaction vessel including a thermometer, a pH meter, and a stirrer, and maintained at 30° C. and a stirring rotation rate of 150 rpm for 30 minutes, while controlling a temperature with a mantle heater from the outside. After that, 0.3 N nitric acid aqueous solution is added to thereby adjust the pH in the aggregation process to 3.0.

A polyaluminium chloride aqueous solution in which 0.7 parts of polyaluminium chloride is dissolved in 7 parts of ion exchange water is added to the mixture, while dispersing with a homogenizer (ULTRA TURRAX T50 manufactured by IKA Japan, K.K.). After that, the temperature is increased to 50° C. while stirring, a particle diameter is measured using a COULTER MULTISIZER II (aperture diameter: 50 μm, manufactured by Beckman Coulter, Inc.), and a volume average particle diameter is adjusted to 5.0 μm. Then, a mixed solution of 27 parts of the polyester resin particle dispersion (1) and 15 parts of the release agent particle dispersion (1) is added. After 30 minutes, 35 parts of the polyester resin particle dispersion (1) and 20 parts of the inorganic mineral dispersion (1) as the inorganic mineral are further added, so that the resin particles and the inorganic minerals are attached (shell structure) to the surfaces of the aggregated particles. Then, a toner (8) is prepared in the same manner as in the preparation of the toner (1).

Comparative Example 1

| Preparation of Toner (Cl) | |
|---|---|
| Ion exchange water: | 215 parts |
| Polyester resin particle dispersion (1): | 170 parts |
| Colorant particle dispersion: | 20 parts |
| Release agent particle dispersion (1): | 33 parts |
| Anionic surfactant (NEOGEN RK manufactured by Dai-Tchi Kogyo Seiyaku Co., Ltd., 20%): | 2.8 parts |

The above components are put in a 3-liter reaction vessel including a thermometer, a pH meter, and a stirrer, and maintained at 30° C. and a stirring rotation rate of 150 rpm for 30 minutes, while controlling a temperature with a mantle heater from the outside. After that, 0.3 N nitric acid aqueous solution is added to thereby adjust the pH in the aggregation process to 3.0.

A polyaluminium chloride aqueous solution in which 0.7 parts of polyaluminium chloride is dissolved in 7 parts of ion exchange water is added to the mixture, while dispersing with a homogenizer (ULTRA TURRAX T50 manufactured by IKA Japan, K.K.). After that, the temperature is increased to 50° C. while stirring, a particle diameter is measured using a COULTER MULTISIZER II (aperture diameter: 50 μm, manufactured by Beckman Coulter, Inc.), and a volume average particle diameter is adjusted to 5.0 μm. Then, 116 parts of the polyester resin particle dispersion (1) is added, so that the resin particles are attached (shell structure) to the surfaces of the aggregated particles.

After adding 20 parts of 10% nitrilotriacetic acid (NTA) metal salt solution (CHELEST 70 manufactured by Chelest Corporation), pH is adjusted to 9.0 using 1 N sodium hydroxide aqueous solution. Then, the temperature is increased to 90° C. by setting a rate of temperature increase at 0.05° C./min, the temperature is maintained at 90° C. for 3 hours, and then the mixture is cooled and filtered to obtain coarse toner particles. This is further re-dispersed in ion exchange water, and filtered, the cycle of the re-dispersion and filtration is repeated to perform washing until electric conductivity of the filtrate becomes equal to or smaller than 20 μS/cm, and the resultant material is subjected to vacuum-drying in an oven at 40° C. for 5 hours, and toner particles (C1) are obtained.

1.5 parts of hydrophobic silica (RY50 manufactured by Nippon Aerosil Co. Ltd.) and 1.0 part of hydrophobic titanium oxide (T805 manufactured by Nippon Aerosil Co. Ltd.) are mixed with respect to 100 parts of the obtained toner particles (C1) using a sample mill at 10,000 rpm for 30 seconds. After that, the mixture is sieved by a vibration sieving device having an aperture of 45 μm, and a toner (C1)

is prepared. A volume average particle diameter of the obtained toner (C1) is 6.1 μm.

Comparative Example 2

| Preparation of Toner (C2) | |
|---|---|
| Ion exchange water: | 215 parts |
| Polyester resin particle dispersion (1): | 203 parts |
| Colorant particle dispersion: | 20 parts |
| Anionic surfactant (NEOGEN RK manufactured by Dai-Ichi Kogyo Seiyaku Co., Ltd., 20%): | 2.8 parts |

The above components are put in a 3-liter reaction vessel including a thermometer, a pH meter, and a stirrer, and maintained at 30° C. and a stirring rotation rate of 150 rpm for 30 minutes, while controlling a temperature with a mantle heater from the outside. After that, 0.3 N nitric acid aqueous solution is added to thereby adjust the pH in the aggregation process to 3.0.

A polyaluminium chloride aqueous solution in which 0.7 parts of polyaluminium chloride is dissolved in 7 parts of ion exchange water is added to the mixture, while dispersing with a homogenizer (ULTRA TURRAX T50 manufactured by IKA Japan, K.K.). After that, the temperature is increased to 50° C. while stirring, a particle diameter is measured using a COULTER MULTISIZER II (aperture diameter: 50 μm, manufactured by Beckman Coulter, Inc.), and a volume average particle diameter is adjusted to 5.0 μm. Then, 45 parts of the polyester resin particle dispersion (1) is added. After 30 minutes, a mixed solution of 57 parts of the polyester resin particle dispersion (1) and 15 parts of the release agent particle dispersion (1) is added, so that the release agent particles and the resin particles are attached (shell structure) to the surfaces of the aggregated particles.

After adding 20 parts of 10% by weight nitrilotriacetic acid (NTA) metal salt solution (CHELEST 70 manufactured by Chelest Corporation), pH is adjusted to 9.0 using 1 N sodium hydroxide aqueous solution. Then, the temperature is increased to 90° C. by setting a rate of temperature increase at 0.05° C./min, the temperature is maintained at 90° C. for 3 hours, and then the mixture is cooled and filtered to obtain coarse toner particles. This is further re-dispersed in ion exchange water and filtered, the cycle of the re-dispersion and filtration is repeated to perform washing until electric conductivity of the filtrate becomes equal to or smaller than 20 μS/cm, and the resultant material is subjected to vacuum-drying in an oven at 40° C. for 5 hours, and thus, toner particles (C2) are obtained.

1.5 parts by weight of hydrophobic silica (RY50 manufactured by Nippon Aerosil Co. Ltd.) and 1.0 part by weight of hydrophobic titanium oxide (T805 manufactured by Nippon Aerosil Co. Ltd.) are mixed with respect to 100 parts by weight of the obtained toner particles (C2) using a sample mill at 10,000 rpm for 30 seconds. After that, the mixture is sieved by a vibration sieving device having an aperture of 45 μm, and a toner (C2) is prepared. A volume average particle diameter of the obtained toner (C2) is 6.1 μm.

Comparative Example 3

| Preparation of Toner (C3) | |
|---|---|
| Ion exchange water: | 215 parts |
| Polyester resin particle dispersion (1): | 170 parts |

-continued

| Preparation of Toner (C3) | |
|---|---|
| Colorant particle dispersion: | 20 parts |
| Release agent particle dispersion (1): | 33 parts |
| Anionic surfactant: (NEOGEN RK manufactured by Dai-Ichi Kogyo Seiyaku Co., Ltd., 20%) | 2.8 parts |

The above components are put in a 3-liter reaction vessel including a thermometer, a pH meter, and a stirrer, and maintained at 30° C. and a stirring rotation rate of 150 rpm for 30 minutes, while controlling a temperature with a mantle heater from the outside. After that, 0.3 N nitric acid aqueous solution is added to thereby adjust the pH in the aggregation process to 3.0.

A polyaluminium chloride aqueous solution in which 0.7 parts of polyaluminium chloride is dissolved in 7 parts of ion exchange water is added to the mixture, while dispersing with a homogenizer (ULTRA TURRAX T50 manufactured by IKA Japan, K.K.). After that, the temperature is increased to 50° C. while stirring, a particle diameter is measured using a COULER MULTISIZER II (aperture diameter: 50 μm, manufactured by Beckman Coulter, Inc.), and a volume average particle diameter is adjusted to 5.0 μm. Then, 110 parts of the polyester resin particle dispersion (1) and 20 parts of the inorganic mineral dispersion (1) are added, so that the resin particles and the inorganic mineral are attached (shell structure) to the surfaces of the aggregated particles.

After adding 20 parts of 10% nitrilotriacetic acid (NTA) metal salt solution (CHELEST 70 manufactured by Chelest Corporation), pH is adjusted to 9.0 using 1 N sodium hydroxide aqueous solution. Then, the temperature is increased to 90° C. by setting a rate of temperature increase at 0.05° C./min, the temperature is maintained at 90° C. for 3 hours, and then the mixture is cooled and filtered to obtain coarse toner particles. This is further re-dispersed in ion exchange water and filtered, the cycle of the re-dispersion and filtration is repeated to perform washing until electric conductivity of the filtrate becomes equal to or smaller than 20 μS/cm, and the resultant material is subjected to vacuum-drying in an oven at 40° C. for 5 hours, and toner particles (C3) are obtained.

1.5 parts of hydrophobic silica (RY50 manufactured by Nippon Aerosil Co. Ltd.) and 1.0 part of hydrophobic titanium oxide (T805 manufactured by Nippon Aerosil Co. Ltd.) are mixed with respect to 100 parts of the obtained toner particles (C3) using a sample mill at 10,000 rpm for 30 seconds. After that, the mixture is sieved by a vibration sieving device having an aperture of 45 μm, and a toner (C3) is prepared. A volume average particle diameter of the obtained toner (C3) is 6.1 μm.

| Preparation of Carrier | |
|---|---|
| Ferrite particles (volume average particle diameter of 35 μm): | 100 parts |
| Toluene: | 14 parts |
| Perfluoroacrylate copolymer (critical surface tension of 24 dyn/cm): | 1.6 parts |
| Carbon black (product name: VXC-72 manufactured by Cabot Corporation, volume resistivity: equal to or smaller than 100 Ωcm): | 0.12 parts |
| Crosslinking melamine resin particles (average particle diameter: 0.3 μm, toluene-insoluble): | 0.3 parts |

First, a solution obtained by diluting carbon black in toluene is added to a perfluoroacrylate copolymer and the resultant is dispersed by a sand mill. The above components except for ferrite particles are dispersed therein with a stirrer for 10 minutes and a coating layer forming solution is prepared. Then, the coating layer forming solution and the ferrite particles are put in a vacuum degassing type kneader, and stirred at 60° C. for 30 minutes, toluene is distilled away under the reduced pressure, and thus, a resin coating layer is formed to obtain a carrier.

Preparation of Developer 36 parts of the toner (1) and 414 parts of the carrier are put in a 2-liter V-blender, stirred for 20 minutes, and sieved with a sieve having an aperture of 212 μm, and a developer (1) is prepared.

Developers (2) to (C3) are prepared in the same manner as in the preparation of the developer (1), except for using the toner prepared in each example instead of the toner (1).

Evaluation

Evaluation of Image Deletion

"DOCUCENTRE COLOR 400CP" manufactured by Fuji Xerox Co., Ltd. is prepared as an image forming apparatus, and a developing device is filled with each developer obtained.

Images based on The Imaging Society of Japan Test Chart No. 8 (image density of 5%) are continuously printed on 10,000 A4-sized sheets using the image forming apparatus in a high temperature and high humidity environment (in an environment of temperature of 32° C. and humidity of 90 RH %). Then, solid images having image density of 90% and a toner amount of 5.0 g/m$^2$ are printed on 100 A4-sized sheets and the images on the first 10 printed sheets are visually observed.

Evaluation Criteria

A: no image deletion is observed in any images

B: image deletion is observed in some images but it is in an acceptable level

C: image deletion which is visually clearly recognized is observed in some images and is in an unacceptable level Evaluation of Peeling Properties As an image forming apparatus which forms an image for evaluation, an apparatus obtained by modifying "DOCUCENTRE-IV C4700P" manufactured by Fuji Xerox Co., Ltd. so as to print an unfixed image up to an edge of the paper is prepared, a developing device is filled with each developer obtained, and a toner cartridge is filled with each toner obtained. Then, a full solid image having a toner amount of 0.8 mg/cm$^2$ is formed on an SP sheet (paper thickness of 81 μm and paper weight of 60 g/m$^2$ manufactured by Fuji Xerox Co., Ltd.), and 100 sheets are continuously printed by setting a fixing temperature to 180° C. and a process speed to 220 mm/sec. The following evaluations are performed with respect to the obtained image on the 100th sheet. The evaluation is performed in the environment of a temperature of 25° C. and humidity of 60%. A state of the edge of the sheet is observed with respect to obtained image on the 100th sheet and evaluated with the following criteria.

Evaluation Criteria

A: peeling failure has not occurred and the state of the edge of the sheet is also excellent B: peeling failure has not occurred and the edge of the sheet is slightly curled C: slight peeling failure has occurred and the edge of the image is slightly disturbed D: peeling failure has clearly occurred The presence ratio of the inorganic mineral, the presence ratio of the release agent, and the percentage of the specific release agent domains are measured by the methods described above.

TABLE 1

| | Inorganic mineral | | | Release agent | | | | | |
|---|---|---|---|---|---|---|---|---|---|
| | | Presence ratio | | | Presence ratio | | Percentage | | |
| | Kind | 400 nm from surface % | 300 nm from surface % | Dispersion No. | 400 nm from surface % | 300 nm from surface % | of specific release agent domains % | Evaluation Image deletion | Evaluation Peeling properties |
| Ex. 1 | Smectite | 95 | 85 | (1) | 90 | 20 | 70 | A | A |
| Ex. 2 | Kaolinite | 95 | 80 | (1) | 90 | 15 | 70 | A | A |
| Ex. 3 | Smectite | 95 | 80 | (1) | 95 | 20 | 60 | A | B |
| Ex. 4 | Smectite | 95 | 85 | (1) | 80 | 15 | 70 | A | A |
| Ex. 5 | Smectite | 95 | 80 | (2) | 85 | 17 | 60 | A | A |
| Ex. 6 | Smectite | 95 | 85 | (3) | 80 | 15 | 10 | A | B |
| Ex. 7 | Smectite | 95 | 65 | (1) | 95 | 65 | 70 | B | B |
| Ex. 8 | Smectite | 95 | 95 | (1) | 95 | 80 | 70 | B | B |
| Com. Ex. 1 | None | 0 | 0 | (1) | 10 | 0 | 10 | C | D |
| Com. Ex. 2 | None | 0 | 0 | (1) | 90 | 65 | 70 | C | A |
| Com. Ex. 3 | Smectite | 100 | 70 | (1) | 10 | 0 | 10 | A | D |

In Table 1, the "presence ratio" in a column of the inorganic mineral shows a percentage of the inorganic mineral present in a portion within 400 nm or 300 nm from the surface of the toner particle with respect to the entire inorganic mineral.

The "presence ratio" in a column of the release agent shows a percentage of the release agent present in a portion within 400 nm or 300 nm from the surface of the toner particle with respect to the entire release agent.

The "percentage of the specific release agent domains" means a percentage of the toner particles including the specific release agent domains in the entire toner particles.

From the above results, it is found that results of evaluation of "image deletion" are excellent in the examples, compared to the comparative examples. Accordingly, it is found that occurrence of image deletion is prevented in the examples, compared to the comparative examples.

In addition, it is found that "peeling properties" are excellent in the examples, compared to the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a toner particle containing a binder resin, a release agent, and an inorganic mineral, wherein 80% or more of the entire release agent is present in a portion within 400 nm from a surface of the toner particle, and 80% or more of the entire inorganic mineral is present in a portion within 400 nm from the surface of the toner particle.

2. The electrostatic charge image developing toner according to claim 1, wherein 20% or less of the entire release agent is present in a portion within 300 nm from the surface of the toner particle, and 80% or more of the entire inorganic mineral is present in a portion within 300 nm from the surface of the toner particle.

3. The electrostatic charge image developing toner according to claim 1, wherein the release agent forms release agent domains satisfying Conditions (1) to (4):

Condition (1): a length of the release agent domain in a long axis direction is from 300 nm to 1200 nm;

Condition (2): a ratio between a length of the release agent domain in a long axis direction and a length thereof in a short axis direction (length in a long axis direction/length in a short axis direction) is from 3.0 to 15.0;

Condition (3): an angle formed by a tangent line passing a tangent point of a circumference of a circle centered at a centroid of the release agent domain and inscribed in an outer edge of the toner particle and the outer edge, and a line which passes the centroid of the release agent domain and extends in the long axis direction of the release agent domain is from 0° to 45°; and Condition (4): a ratio between a circle equivalent diameter of the toner particle and a distance A between the centroid of the release agent domain and the tangent point (distance A/circle equivalent diameter) is from 0.03 to 0.25.

4. The electrostatic charge image developing toner according to claim 1, wherein the inorganic mineral is a layered clay mineral.

5. The electrostatic charge image developing toner according to claim 4, wherein the layered clay mineral is selected from the group consisting of kaolinite, smectite, illite, mica, vermiculite, talc, pyrophyllite, and chlorite.

6. The electrostatic charge image developing toner according to claim 1, wherein a content of the inorganic mineral is from 1% by weight to 10% by weight with respect to the entire toner particles.

7. The electrostatic charge image developing toner according to claim 1, wherein a weight ratio of the inorganic mineral to the release agent is in a range of from 1:1 to 1:15.

8. An electrostatic charge image developer, comprising a carrier and the electrostatic charge image developing toner according to claim 1.

9. A toner cartridge which is detachable from an image forming apparatus comprising:

a storing portion that stores the electrostatic charge image developing toner according to claim 1.

* * * * *